United States Patent [19]

Elmore

[11] 4,110,597

[45] Aug. 29, 1978

[54] HEATING DEVICE

[76] Inventor: Theodore V. Elmore, 7570 Highway 65 NE., Fridley, Minn. 55432

[21] Appl. No.: 683,462

[22] Filed: May 5, 1976

[51] Int. Cl.[2] ..... H05B 1/00

[52] U.S. Cl. ..... 219/200; 37/12; 138/33; 165/47; 219/213; 219/342; 219/343; 219/531; 219/534; 219/535; 219/552

[58] Field of Search ..... 174/153 G; 138/32, 33, 138/103; 219/200, 213, 311, 342, 343, 460, 531, 534, 535, 552, 526, 369; 165/47; 37/12

[56] References Cited

U.S. PATENT DOCUMENTS

| | | | |
|---|---|---|---|
| 606,792 | 7/1898 | Quidas | 219/342 |
| 619,314 | 2/1899 | Jones | 219/531 |
| 1,489,444 | 4/1924 | Kestler | 138/33 |
| 1,500,696 | 7/1924 | White | 219/531 |
| 2,000,751 | 5/1935 | Glick | 219/535 |
| 2,507,039 | 5/1950 | Miller | 219/526 X |
| 2,683,939 | 7/1954 | Meltzer et al. | 219/369 X |
| 3,207,887 | 9/1965 | Drugmand et al. | 219/535 |
| 3,272,968 | 9/1966 | Volkar | 219/535 |
| 3,499,097 | 3/1970 | Widstrand | 174/153 G X |
| 3,510,628 | 5/1970 | Zahaykevich | 174/153 G X |
| 3,784,785 | 1/1974 | Noland | 138/33 X |
| 3,971,416 | 7/1976 | Johnson | 219/301 X |

FOREIGN PATENT DOCUMENTS

| | | | |
|---|---|---|---|
| 536,144 | 11/1955 | Italy | 219/248 |

*Primary Examiner*—Thomas J. Kozma
*Attorney, Agent, or Firm*—Burd, Braddock & Bartz

[57] ABSTRACT

A heating device for installation on the roof of a structure to permit water to flow off the structure from behind a blockage of ice. An elongate, hollow tubular member defines a chamber in which is situated a point heat source. A jacket of insulative material surrounds the tubular member to retard heat loss. One side of the jacket faces the roof and has a channel open to the tubular member such that heat transfer from the tubular member occurs primarily through the channel. When the device is installed on a roof, heat radiated through the channel forms heated passageways through the ice blockage for escape of water.

16 Claims, 7 Drawing Figures

FIG. 1
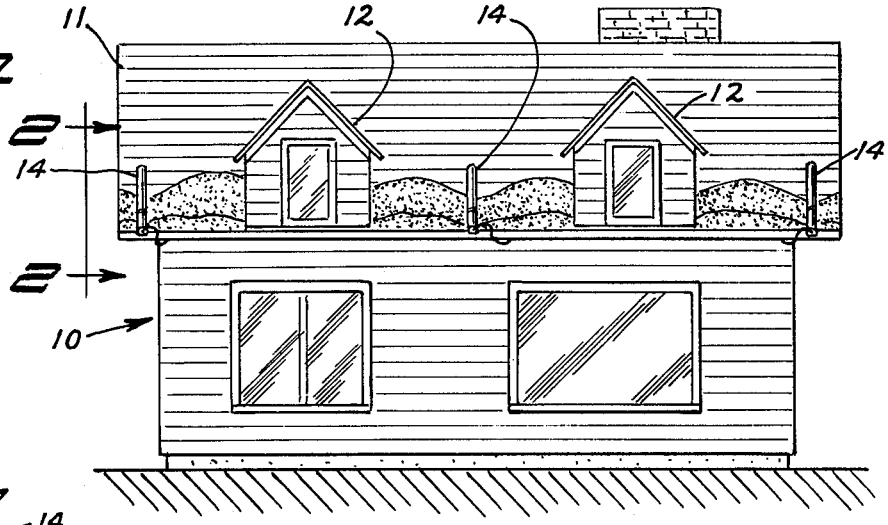
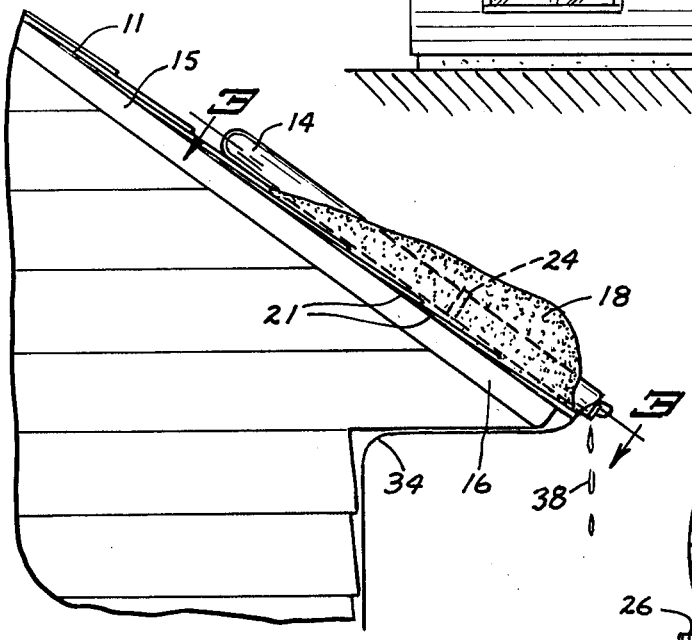
FIG. 2
FIG. 4
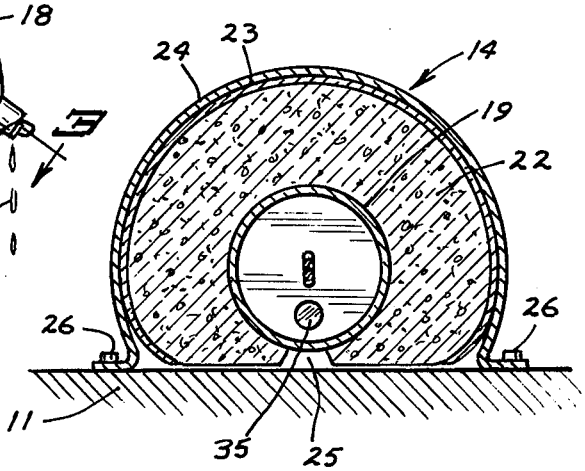
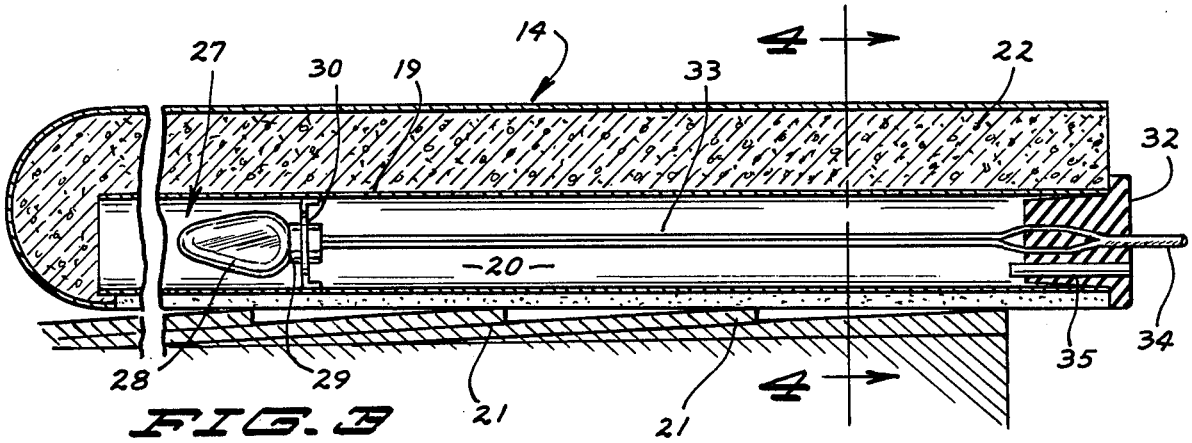
FIG. 3

FIG. 5
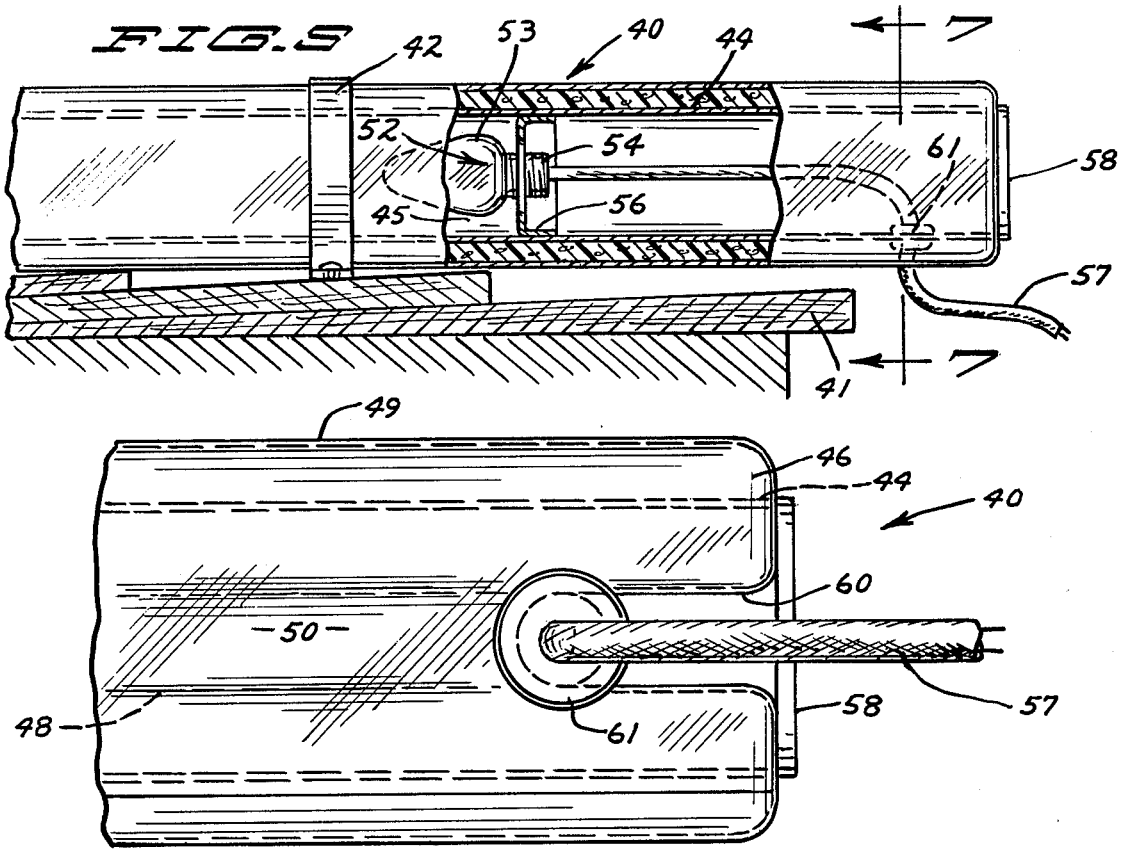
FIG. 6
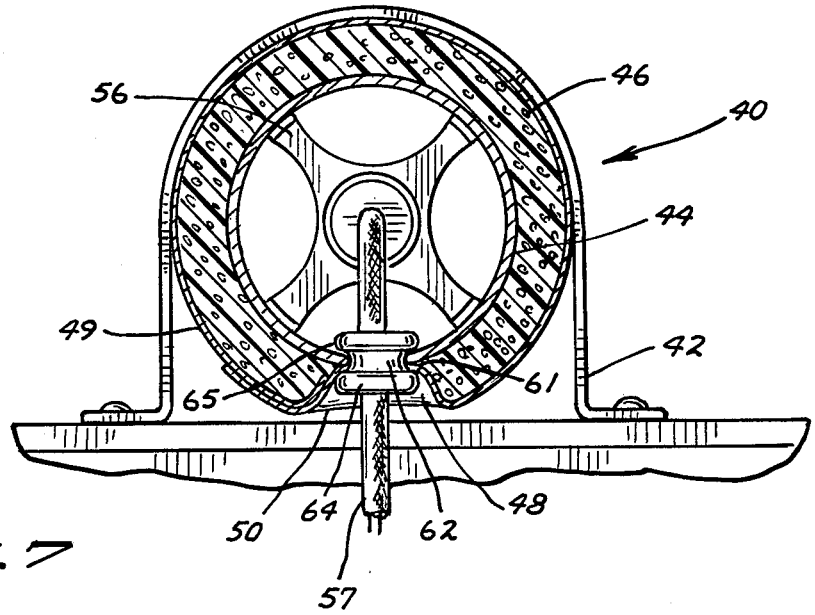
FIG. 7

HEATING DEVICE

BACKGROUND OF THE INVENTION

In cold winter climates in the wintertime, there is a significant problem of ice build-up of the roofs of heated buildings, and particularly houses. Houses are typically constructed with the edge portions of the pitched roof extending beyond the main frame of the house. The major portion of the roof of the house located above the main frame receives some heat due to heat rising up from the warm house interior. This heat, alone or in combination with heat from the sun, can cause melting of snow and ice located over the major portion of the roof that covers the main frame of the house. The extended minor roof portion is not directly over the main house frame and thus is not heated to the same extent as the major roof portion. Water from melted ice or snow on the major roof portion running off the roof has a propensity to refreeze when it reaches this colder, extended portion of the roof. Gradually, a blockage of ice can build up at the edge of the roof. This ice blockage prevents further flow of water from melted snow and ice from the major roof portion. When this additional flow reaches the ice blockage it is stopped and caused to back up, oftentimes backing up underneath the roof shingles and causing damage. Not only can damage to the roof result, but water may enter the interior of the house and damage the walls and ceilings thereof.

Various devices have been proposed to melt a portion of this ice blockage on the roof and permit water flowage. For example, see the devices of U.S. Pat. No. 3,141,955 issued July 21, 1974, to Culpepper and U.S. Pat. No. 3,725,638 issued Apr. 3, 1973, to Solin et al. Also, there are available devices known as heat tapes or cables which are laid along the roof edge and the electrically heated to attempt to prevent such ice blockage. Operation of these devices is expensive, and sometimes prohibitively so, due to the amount of electricity consumed in generating the heat. The majority of heat generated by such devices is lost to the surrounding atmosphere. Relatively little of the heat is used for the desirable purpose of melting the ice.

SUMMARY OF THE INVENTION

The invention relates to a heating device for installation on the roof of a heated building, particularly a house having a pitched roof. The device includes an elongate, hollow tubular member or housing defining an elongate chamber. A low power heat source is located in the chamber and can be comprised as a low power light bulb. The tubular member is surrounded by or encased in an insulative jacket which retards heat loss. The jacket has a side adapted for disposition facing the roof surface positioned generally parallel to the inclination of the roof. A heat conductive channel is formed in the side of the jacket facing the roof and is open to the tubular member and the roof such that heat transfer from the tubular member occurs primarily through the channel directed toward the roof. The channel extends the length of the jacket to heat the roof surface area in the vicinity of the device to form passageways for water flow off the edge of the roof. When the device is installed upon the roof of a house, the channel heats a localized passage through an ice blockage to permit the flow of water therethrough. Since heat loss occurs primarily only through the channel to heat the passage, the power requirement of the heat source is relatively low.

In one form of the invention, the elongate tubular member has one end closed by a plug. An optic fiber member extends through the plug and permits visual determination of whether the heat source, comprised of a low-watt light bulb, is operative.

IN THE DRAWINGS:

FIG. 1 is a side elevational view of a house having a roof with a plurality of heating devices according to one embodiment of the present invention installed thereon;

FIG. 2 is an enlarged side elevational view of a heating device installed on the roof of the house of FIG. 1 taken along the line 2—2 of FIG. 1;

FIG. 3 is an enlarged sectional view of the heating device of FIG. 2 taken along the line 3—3 thereof;

FIG. 4 is a sectional view of the heating device of FIG. 3 taken along the line 4—4 thereof;

FIG. 5 is a fragmentary sectional view of a heating device according to another embodiment of the invention;

FIG. 6 is an enlarged bottom plan view of a portion of the heating device shown in FIG. 5; and FIG. 7 is an enlarged sectional view of FIG. 5 taken along the line 7—7 thereof.

DESCRIPTION OF PREFERRED EMBODIMENTS

Referring to the drawings, there is shown in FIGS. 1 and 2 a house 10 having a pitched, shingled roof 11. A pair of dormers 12 are located on roof 11, as are a plurality of heating devices 14 according to one form of the present invention. Heating devices 14 are located on roof sections separated by the dormers. Roof 11 has a major portion 15 located over the main frame of house 10 which thus receives heat rising from house 10. Roof 11 has a minor or extended portion 16 constituted as an integral extension of major roof portion 15 beyond the main frame of the house. Minor roof portion 16 does not receive heat rising through the main frame of the house and thus is usually colder than the major roof portion 15. Snow located on the major roof portion 15 is melted by heat rising from the main frame of the house as well as by the sun. Melted snow in the form of water runs down the major portion of the roof 11 until it reaches the colder, minor roof portion 16. Upon reaching the colder, minor roof portion 16, the water is prone to refreeze along the edge of the roof, thus forming a blockage of ice shown at 18 in FIG. 2. Ice blockage 18 normally tends to retard the further flow of water off the major roof portion 15 which then tends to back up underneath the roof shingles 21 and cause damage. Through the use of the heating devices of the present invention, discrete passageways are formed through the ice blockage 18 which permits the flow of water from the major roof portion 15 off the edge of the roof. This is efficiently accomplished by the heating devices 14 with the use of a minimum of electrical energy.

As shown in FIGS. 3 and 4, a heating device 14 includes an elongate, tubular, pipe-like member or housing 19 which can be formed of heat conductive metal and has a generally cylindrical side wall defining an elongate chamber 20. Housing 19 is located on roof 11 with its longitudinal axis parallel to the inclination of the roof whereby the heating device 14 lies on the roof 11 generally aligned with the pitch of the roof. A flanged bracket 24 fastened to roof 11 by suitable screws 26 can be used to hold heating device 14 in place. Other suitable fastening means can be used.

An insulative jacket 22 covers or encloses the length of tubular member 19 in order to retard uncontrolled heat loss from chamber 20. Jacket 22 can be comprised of any suitable insulative material such as expanded plastic foam molded around or sprayed upon tubular member 19, an insulative foam plastic sheet wrapper around tubular member 19, or the like. As shown, jacket 22 can cover the upper end of member 19 or a suitable plug can be provided to close the end. An outer skin 23 encloses the jacket 22 for protection and can be comprised of an efficient solar collecting material to assist in heating the device 14.

As shown in FIGS. 3 and 4, one side of jacket 22 has edges defining a longitudinal heat transfer channel 25 extending the length of tubular member 19 providing an opening between tubular member 19 and the exterior of heating device 14. Channel 25 is coextensive with the length of tubular member 19 in order to permit directed heat loss from the chamber 20. Heating device 14 is installed on roof 11 with the channel 25 facing the surface of the roof in alignment with the pitch of the roof. Heat transfer from the chamber 20 is directed through the channel 25 onto the adjacent surface of roof 11. As shown, portions of jacket 22 adjacent channel 25 can be flattened to more closely conform to the roof surface.

Heating means located in the chamber 20 includes a point heat source 27 preferably comprised as a low power light bulb 28. Bulb 28 is mounted in electrical socket 29 which is held in position in the chamber 20 by a fingered clip 30 having fingers in biasing engagement with the side walls of tubular member 19. Bulb 28 can be positioned in chamber 20 at approximately one-third the length of heating device 14 measured from the lower end thereof and is effective to heat the air in chamber 20 relatively uniformly. The power of the light bulb 28 need only be between five and ten watts whereby operation of heating device 14 during the winter months is very economical.

A plug 32 closes the lower end of tubular member 19 and is removable for replacement of the bulb 28. Electrical wires 33 extend from the light bulb receptacle 29 to the plug 32. A conventional power cord 34 connects with electrical wires 33 in the plug 32 and is extendable to a location inside the house for receipt of power from a standard household electrical socket. Plug 32 may be plastic, rubber or the like to snugly and sealably fit in the end of tubular member 19. An optic fiber strand 35 extends through the plug 32 and is of a light transmitting material. The purpose of optic fiber strand 35 is to permit visual determination from outside of the heating device 14 of whether or not the light bulb 28 is operative. Removal of the plug 32 affects removal of the light bulb 28 simply by pulling it out for replacement when necessary.

In use, heating devices 14 are installed on separate expanses of roof 11 which are separated by obstacles or structures such as the dormers 12. The heating device 14 lies parallel to the pitch of roof 11 and has a lower end which overlaps the roof edge. The heating devices can be between two and four feet long depending on the amount of outward extension of minor portion 16 of roof 11. If there is a gutter, the lower end of device 14 is positioned to extend out beyond the gutter.

By connection of power cord 34 with an inside electrical outlet, light bulb 28 is energized and radiates heat. Visual determination of light emanating from chamber 20 through optic fiber 35 confirms the operability of light bulb 28. The heat generated by the light bulb 28 is well contained in chamber 20 by jacket 22 whereby the power requirement of light bulb 28 is low. The only significant heat transfer occurs through channel 25.

Channel 25 faces the roof to supply heat to a localized portion thereof to provide a longitudinal path of travel for free water through ice blockage 18. Heat generated from tubular member 19 to channel 25 keeps the channel free of ice and snow. The longitudinal outside edges of the jacket 22 adjacent the roof also release sufficient heat to permit water passage along the edges of the device 14. Shingles 21 of roof 11 are laid in overlapping relationship such that the root or valley between adjacent shingles, as shown in FIG. 3, presents a path or opening for free water to flow under jacket 22 to the channel 25. The water then flows down the heated channel 25 until it reaches the roof edge where it drops off, as at 38 in FIG. 2, before it reaches plug 32. Channel 25 is high enough such that water never contacts tubular member 19.

If there is a gutter along the edge of roof 11, the end of the heating device 14 rests on the gutter edge and overlaps it slightly, which might cause channel 25 to be spaced from the roof surface by a distance progressively increasing from the upper end toward the lower end. Nonetheless, the heat generated through channel 25 is ample to maintain an open passage for flow of free water occurring behind ice blockage 18.

As free water on the roof tends to seek its own level, a single heating device 14 is adequate to affect drainage of free water behind ice blockage from a relatively long roof expanse.

Referring to FIGS. 5–7, there is shown a heating device, indicated generally at 40, according to a second embodiment of the invention, installed on a pitched roof 41 of a heated dwelling and held in place there by suitable bracket 42. Heating device 40 includes an elongate, tubular, pipe-like member or housing 44 having a generally cylindrical side wall defining an elongate chamber 45. The longitudinal axis of housing 44 lies parallel to the inclination of the roof.

An insulative jacket 46 covers or encloses the length of tubular member 44 in order to retard uncontrolled heat loss from the chamber 45. Jacket 46 is comprised of an insulative foam plastic sheet wrapped around the tubular member 44 and held thereto by glue or other suitable means.

An elongate channel 48 is formed in jacket 46 extending substantially the length of tubular member 44. Channel 48 faces the roof and is open to the side wall of tubular member 44 to permit directed heat loss from the chamber 45 towards the roof. Heat transfer from chamber 45 occurs primarily through the channel 48 due to the insulative qualities of jacket 46. Heat loss to the surrounding atmosphere is minimized.

An outer skin 49 encloses the jacket 46 and the tubular member 44, having a portion 50 spanning the channel 48. The skin 49 is an appropriate sheet material such as a suitable plastic. The portion 50 spanning channel 48 prevents water from entering and soaking jacket 46, yet does not impede heat loss through the channel 48 to the roof section directly beneath the channel and along the outside adjacent edges of jacket 46 adjacent the roof 41.

A point heat source 52 is located in chamber 45 and preferably is comprised as a low power light bulb 53. Bulb 53 is mounted in an electrical socket 54 which is held in position in the chamber 45 by a fingered clip 56 having fingers in biasing engagement with the side walls of tubular member 44. Bulb 53 can be positioned in chamber 45 at approximately one-third the length of heating device 40 measured from the lower end thereof and is effective to uniformly heat the air in chamber 45. A power cord 57 supplies electrical power to the socket 54. An end plug 58 closes the lower end of tubular member 44 and is removable for replacement of the light bulb 53. Plug 58 can be comprised of a translucent material in order to permit visual determination of the operability of the light bulb 53 from outside.

Referring to FIGS. 6 and 7, a longitudinal slot 60 is located at the lower end of tubular member 44 in contiguous relationship to the channel 48. A tubular strain relief bushing or collar 61 is slidably accommodated in the slot 60. Collar 61 has a necked-in central portion 62 of a diameter smaller than the width of slot 60 so that it is accommodated in the slot 60. Collar 61 has expanded or flanged ends 64, 65 located on either side of the slot 60 and overlapping the edges thereof to retain the collar 61 in the slot 60. The electrical power cord 57 extends from the receptacle 54 through a central opening in the collar 61 and away from the heating device 40. The purpose of the slot 60 and the collar 61 is to space the electrical cord 57 away from the end of the heating device 40 so that water running down to the end of the heating device 40 does not accumulate as ice on the power cord 57.

In use, heating device 40 is installed on the pitched roof of a heated building, parallel to the inclination of the roof and with the lower end extending over the roof edge. Actuated light bulb 53 heats chamber 45. Heat transfer through the tubular member 44 is directed through the channel 48 while the jacket 46 insulates the tubular member 44 from other heat loss. The heat is transferred through the channel 48 and the covering skin portion 50 to the roof surface beneath the channel 48 and the roof surface adjacent the edges of the heating device 40. Passageways for the flow of water are formed adjacent the outer edges of the heating device closest to the roof and also beneath the channel 48 if the heating device is slightly elevated from the roof surface. Water behind an ice blockage can flow along these formed passageways and drop off the edge of the roof.

While there has been shown and described preferred embodiments of heating devices according to the present invention, it will be apparent to those skilled in the art that certain alterations and deviations may be had from the embodiments shown without departing from the scope and spirit of the appended claims.

The embodiments of the invention in which an exclusive property or privilege is claimed are defined as follows:

1. A heating device for installation on the pitched roof of a heated building to permit drainage of ice-blocked water from the roof of the building, comprising:

an elongate tubular housing defining a substantially closed chamber and having an end extendible over the roof edge of a building;

heating means located in the chamber;

a heat insulative jacket surrounding said housing to retard heat loss from the chamber;

said housing and jacket configured to be installable on a roof substantially parallel to the pitch thereof with a side of the housing in facing relationship to the surface of the roof;

means securing the housing to a roof with said side of the housing in facing relationship to the roof;

said jacket having a heat conductive channel on said side of the housing in facing relationship to said surface of the roof when the housing and jacket are installed on the roof substantially coextensive with the length of the housing and open through the jacket to the housing and to the roof for transfer of heat from the housing whereby heat generated by the heating means is transferred from the chamber toward the roof surface to form a heated passageway for drainage of water past an ice blockage.

2. The heating device of claim 1 wherein: said heating means includes a point heat source located in the chamber.

3. The heating device of claim 2 wherein: said point heat source includes a low power light bulb.

4. The heating device of claim 3 wherein: one end of said tubular member is closed by a removable plug, said plug having an optic fiber passing therethrough to the chamber and visible from outside the housing for visual determination of operability of the light bulb.

5. The heating device of claim 1 wherein: said insulative jacket includes an expanded foam jacket surrounding said housing.

6. The heating device of claim 1 wherein: said insulative jacket includes a foamed plastic sheet wrapped around said tubular housing.

7. The heating device of claim 1 wherein: said heating means includes a lower power light bulb located in the chamber and having an electrical power cord extending from the chamber, said housing having a slot at one end thereof, a strain relief bushing located in the slot, said strain relief bushing accommodating a portion of the electrical power cord.

8. The heating device of claim 1 wherein: said jacket is comprised of a plastic foam material and including a protective skin surrounding said jacket.

9. The heating device of claim 1 wherein: said jacket is comprised of a plastic foam material and including a protective skin surrounding said jacket and spanning said channel.

10. A heating device for installation on the roof of a building to permit drainage of ice-blocked water from the roof of the building comprising:

a housing defining a substantially closed chamber;

heating means located in the chamber;

heat insulative means surrounding said housing to retard heat loss from the chamber;

means securing the housing and heat insulative means to a roof with a side of the housing orientated in facing relationship to the surface of the roof;

said heat insulative means having a heat conducting opening on said side of the housing in facing relationship to the surface of the roof open to the housing and to the roof surface whereby heat generated by the heating means is transfered from the chamber toward the roof surface to form a heated passageway for drainage of water past an ice blockage.

11. The heating device of claim 10 wherein: said heating means includes a point heat source located in the chamber.

12. The heating device of claim 11 wherein: said point heat source includes a low power light bulb.

13. The heating device of claim 12 wherein: said opening in the heat insulative means comprises an elongate channel.

14. The heating device of claim 13 including: a protective skin covering the heat insulative means and spanning said channel.

15. The heating device of claim 10 wherein: said heating means includes a lower power light bulb located in the chamber and having an electrical power cord extending from the chamber, said housing having a slot at one end thereof, a strain relief bushing located in the slot, said strain relief bushing accommodating a portion of the electrical power cord.

16. The heating device of claim 15 wherein: said heat insulative means comprises a jacket formed of a plastic foam material.

* * * * *

UNITED STATES PATENT AND TRADEMARK OFFICE

CERTIFICATE OF CORRECTION

PATENT NO. : 4,110,597

DATED : August 29, 1978

INVENTOR(S) : THEODORE V. ELMORE

It is certified that error appears in the above-identified patent and that said Letters Patent are hereby corrected as shown below:

Column 1, line 36, "the" should be --are.

Column 6, line 30, "lower" should be --low--.

Signed and Sealed this

Thirteenth Day of March 1979

[SEAL]

Attest:

RUTH C. MASON
*Attesting Officer*

DONALD W. BANNER
*Commissioner of Patents and Trademarks*